US005384576A

United States Patent [19]

Tashiro et al.

[11] Patent Number: 5,384,576

[45] Date of Patent: Jan. 24, 1995

[54] CRT DISPLAY DEVICE

[75] Inventors: Tsukasa Tashiro; Shigeo Hayashi, both of Nagano; Toshiyuki Miyazaki; Norihito Sogo, both of Tokyo, all of Japan

[73] Assignees: Totoku Electric Co., Ltd.; Kaga Electronics Co. Ltd., both of Tokyo, Japan

[21] Appl. No.: 108,006

[22] Filed: Aug. 18, 1993

Related U.S. Application Data

[63] Continuation of Ser. No. 757,070, Sep. 9, 1991, abandoned.

[30] Foreign Application Priority Data

Aug. 18, 1990 [JP] Japan ..... 2-248152

[51] Int. Cl.[6] ..... G09G 5/00

[52] U.S. Cl. ..... 345/3; 348/180

[58] Field of Search ..... 340/712, 717, 735, 790, 340/814; 358/192.1, 139; 345/1, 3, 904, 23; 348/180, 184; H04N 17/00, 17/02, 17/04

[56] References Cited

U.S. PATENT DOCUMENTS

| | | | |
|---|---|---|---|
| 3,272,920 | 9/1966 | Meurer | 358/139 |
| 4,170,025 | 10/1979 | Benkley et al. | 358/139 |
| 4,279,035 | 7/1981 | Skerlos | 358/192.1 |
| 4,888,819 | 12/1989 | Oda et al. | 358/192.1 |
| 5,031,118 | 7/1991 | Morizot | 340/732 |
| 5,034,820 | 7/1991 | Cho | 358/192.1 |
| 5,103,315 | 4/1992 | Kufta et al. | 358/192.1 |
| 5,107,259 | 4/1992 | Weitzen et al. | 340/735 |

FOREIGN PATENT DOCUMENTS

| | | | |
|---|---|---|---|
| 0142634 | 8/1983 | Japan | 358/139 |
| 0204331 | 11/1984 | Japan | 358/139 |
| 0674245 | 7/1979 | U.S.S.R. | 358/139 |

*Primary Examiner*—Jeffery Brier

[57] ABSTRACT

A CRT display device on which an input signal which has been processed can form an image signal which results in an image being displayed. The CRT display device has a separate message section which can be a dot matrix display. On this separate message section there is a display where displayed messages indicative of the input signal. The message display section displays messages related to the input signal even when there is no image on the cathode ray tube of the CRT display device so that a user based on these messages can input parameters to provide an image on the CRT. The messages on the display device can be shown in various languages.

19 Claims, 7 Drawing Sheets

FIG. 5

(a) NO H-SYNC (b) NO V-SYNC (c) NO SYNC SIGNAL (d) H-FREQ. OVER (e) H-FREQ. UNDER (f) V-FREQ. OVER (g) V-FREQ. UNDER

FIG. 6

CH13 TOTOKU

FIG. 7

(a)
A= ◀ , ▶ B= ◀▶ , ▶◀
NEXT ? [Y ] ENTER (b)
A= ▲ , ▼ B= ◆ , ⧗
NEXT ? [Y ] ENTER (c)
A= ◖◗ , ◗◖ B= ◭◮ , ◮◭
NEXT ? [Y ] ENTER

CRT DISPLAY DEVICE

This application is a continuation of application Ser. No. 07/757,070 filed on Sep. 9, 1991, now abandoned.

BACKGROUND OF THE INVENTION

This invention relates to CRT (cathode ray tube) display devices, and more particularly to a CRT display device which can display a message representing the state of an input signal by message displaying means provided in addition to a CRT.

A CRT display device used popularly for a personal computer is of automatic frequency follow-up type, so as to respond to the scanning frequency of the personal computer.

However, the CRT display device may suffer from the following difficulty: That is, let us consider the case where the CRT display device connected to a personal computer having a certain scanning frequency is adjusted so as to correctly display images thereon. When this device is connected to another personal computer different in scanning frequency, sometimes it is impossible for the device to correctly display images, because of the different signal timing. In this case, it is necessary for the user to adjust the horizontal size, horizontal position, vertical size and vertical position of the CRT display device.

FIG. 8 shows an external appearance of one example of a conventional CRT display device of automatic frequency follow-up type.

With the CRT display device 51, the user operates operating switches in a display operating section 53 while watching images displayed on a CRT 52, to adjust the horizontal size, horizontal position, vertical size and vertical position.

FIG. 9 shows essential parts of the display operating section 53.

The horizontal size, horizontal position, vertical size and vertical position can be adjusted by key switches 54, 55, 56 and 57, respectively.

In addition, a key switch 58 is operated to store the horizontal size, horizontal position, vertical size and vertical position in an internal non-volatile memory. The symbol marks provided above the key switches 54 through 57 indicate the adjusting functions of those key switches, respectively.

With the above-described conventional CRT display device 51, the horizontal size, horizontal position, vertical size and vertical position can be adjusted in the case where an image is displayed on the CRT. However, the device suffers from a difficulty that, in the case where no image is displayed on the CRT, it cannot be determined why no image is displayed. More specifically, it cannot be determined which of the following reasons has caused the trouble: no input signal is applied thereto because the CRT display device 51 is insufficiently connected to the personal computer or the like, or an input signal applied to the CRT display device from the personal computer or the like is out of the range of tolerance of the CRT display device 51, or others. Thus, in this case, it is rather difficult to deal with the trouble.

SUMMARY OF THE INVENTION

Accordingly, an object of this invention is to provide a CRT display device in which, even when no image is displayed on the CRT, the state of the input signal can be readily detected by the user.

In order to achieve the foregoing object of the invention, a CRT display device in which an input signal is processed to form an image signal, and an image is displayed on a CRT according to the image signal thus formed, according to the invention, comprises: input signal state detecting means for detecting the state of an input signal; message displaying means provided in addition to the CRT; and display control means for displaying a message representing the state of the input signal detected by the input signal state detecting means on the message displaying means.

Preferably, the CRT display device further comprises: display language selecting means, so that the display control means displays the message on the message displaying means in a language selected by the language selecting means.

The term "message representing the state of the input signal" as used herein includes messages as to a horizontal frequency, vertical frequency, and positive and negative polarities.

In the CRT display device of the invention, the display control means operates to display the state of an input signal, in the form of a message, on the message displaying means, which is detected by the input signal state detecting means.

Hence, even when no image is displayed on the CRT, the user can read the message displayed on the message displaying means, to determine why no image is displayed. More specifically, it can be readily determined which of the following reasons has caused the trouble: no input signal is applied thereto because the CRT display device is insufficiently connected to the personal computer or the like, or an input signal applied to the CRT display device from the personal computer or the like is out of the range of tolerance of the CRT display device, or others.

With the CRT display device of the invention, the user can select a desired language among a plurality of languages with the display language selecting means, so that the message be displayed in the language.

That is, the CRT display device can be used for displaying messages in any desired one of the plurality of languages.

Figure 1:
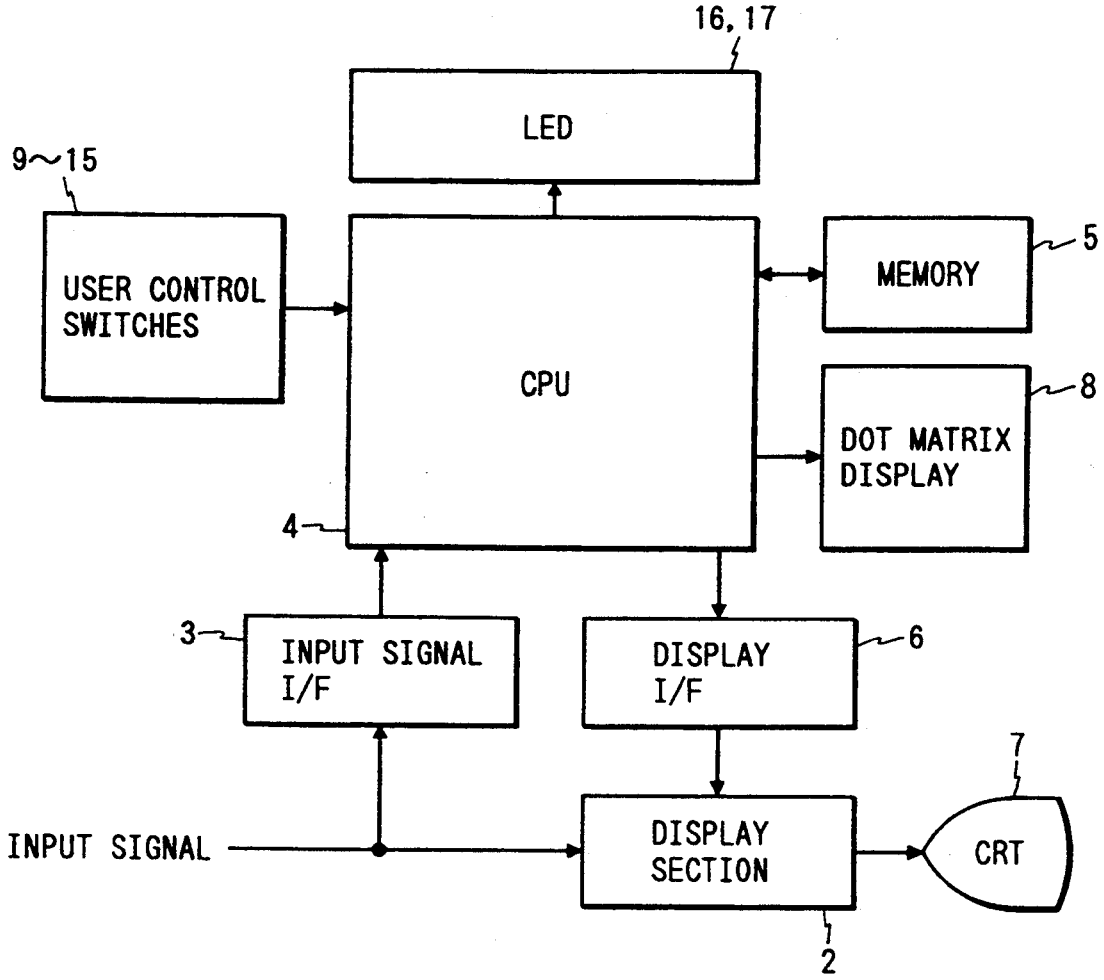
FIG. 1 is a block diagram showing the arrangement of one example of a CRT display device according to this invention.
Figure 8:
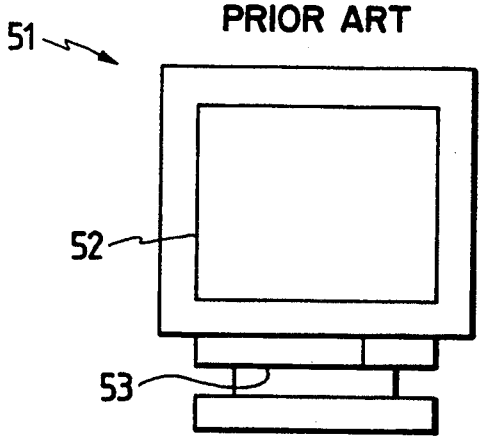
FIG. 8 PRIOR ART
Figure 9:
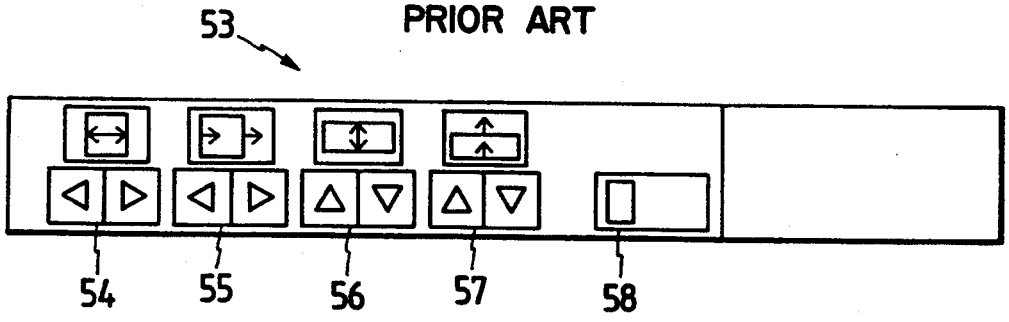
FIG. 9 PRIOR ART

The parts (a), (b) and (c) of FIG. 4 are three parts of a flow chart for a description of essential parts of the operation of the CRT display device shown in FIG. 1;

The parts (a) through (e) of FIG. 5 are explanatory diagrams showing examples of the state of an input signal applied to the CRT display device;

FIG. 6 is an explanatory diagram showing an example of a parameter label display;

The parts (a) through (c) of FIG. 7 are explanatory diagram showing examples of the display of operating switch functions;

FIG. 8 is a diagram showing an external appearance of a conventional CRT display device; and FIG. 9 is a front view showing the arrangement of operating switches provided for the conventional CRT display device.

DESCRIPTION OF PREFERRED EMBODIMENT

This invention will be described with reference to its preferred embodiment shown in the accompanying drawings. However, it should be noted that the invention is not limited thereto or thereby.

FIG. 1 is a block diagram showing the arrangement of the embodiment of the invention, a CRT display device of automatic frequency follow-up type.

In FIG. 1, an input signal is applied to a display section 2, and through an input signal I/F 3 to a CPU 4.

The CPU 4 operates to detect the state of the input signal, and to determine whether or not parameters (such as a horizontal frequency) corresponding to the state of the input signal are preset in a (non-volatile) memory 5. If the parameters are not preset in the memory 5, the CPU operates to display the state of the input signal on a dot matrix display unit 8, and to cause the user to input the parameters corresponding thereto with user's control switches 9 through 15 and LED's 16 and 17 on an interactive basis. The parameters are applied through a display I/F 6 to the display section 2. In the case where, on the other hand, the corresponding parameters are preset in the memory 5, the CPU applies the parameters to the display section 2 through the display I/F 6.

The display section 2 processes the input signal by using the parameters received, to form an image signal, which is applied to a CRT 7.

In response to the image signal, the CRT 7 displays an image.

Figure 2:
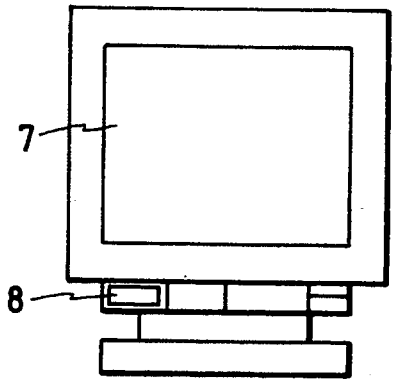
FIG. 2 is a diagram showing an external appearance of the CRT display device.

FIG. 2 shows an external appearance of the CRT display device 1.

The dot matrix display unit 8 is provided below the CRT 7 on the left side. The dot matrix display unit 8 may be made up of LCD (liquid crystal display), LED (light emitting diode), EL (electro-luminescence) or VFD (vacuum fluorescent display).

Figure 3:
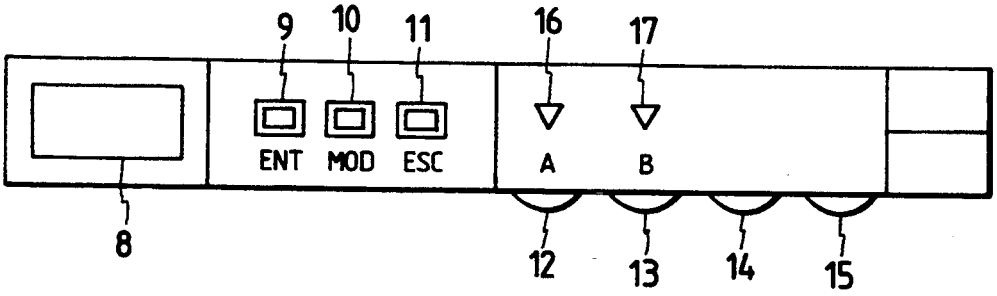
FIG. 3 is a front view showing the arrangement of operating switches on the CRT display device.

FIG. 3 is a front view showing the arrangement of the dot matrix display unit 8, the user's control switches 9 through 15, and the LED's 16 and 17.

The switches 9, 10 and 11 are key switches. The switches 12 through 15 are rotary switches. The key switches 9 through 11 are used to select the functions of the rotary switches 12 through 15. Guides for selection of the functions, and the functions selected are displayed on the dot matrix display unit 8. The rotary switches 12 through 15 are used for adjustment of the functions selected with the key switches 9 through 11.

As is apparent from the above description, the key switches 9 through 11 and the rotary switches 12 through 15 are employed as multi-function switches, and therefore the number of switches can be reduced as much. Furthermore, only a current function is displayed to be easy to operate by the user.

The dot matrix display unit 8 display the message by, for example, one of the English, French, German or the like, which is selected by the key switches 9 through 11.

A language desired for display can be selected in this way. That is, one CRT display device can be for used for displaying data by the one of the plurality of languages. In addition, since the display is made only in a language selected by the user, the user will not be confused by the unselected foreign language.

Since the dot matrix display unit 8 is employed as a message display means, it is easy display the message in different languages if the fonts of the languages are stored in the memory 5.

Figure 4A:
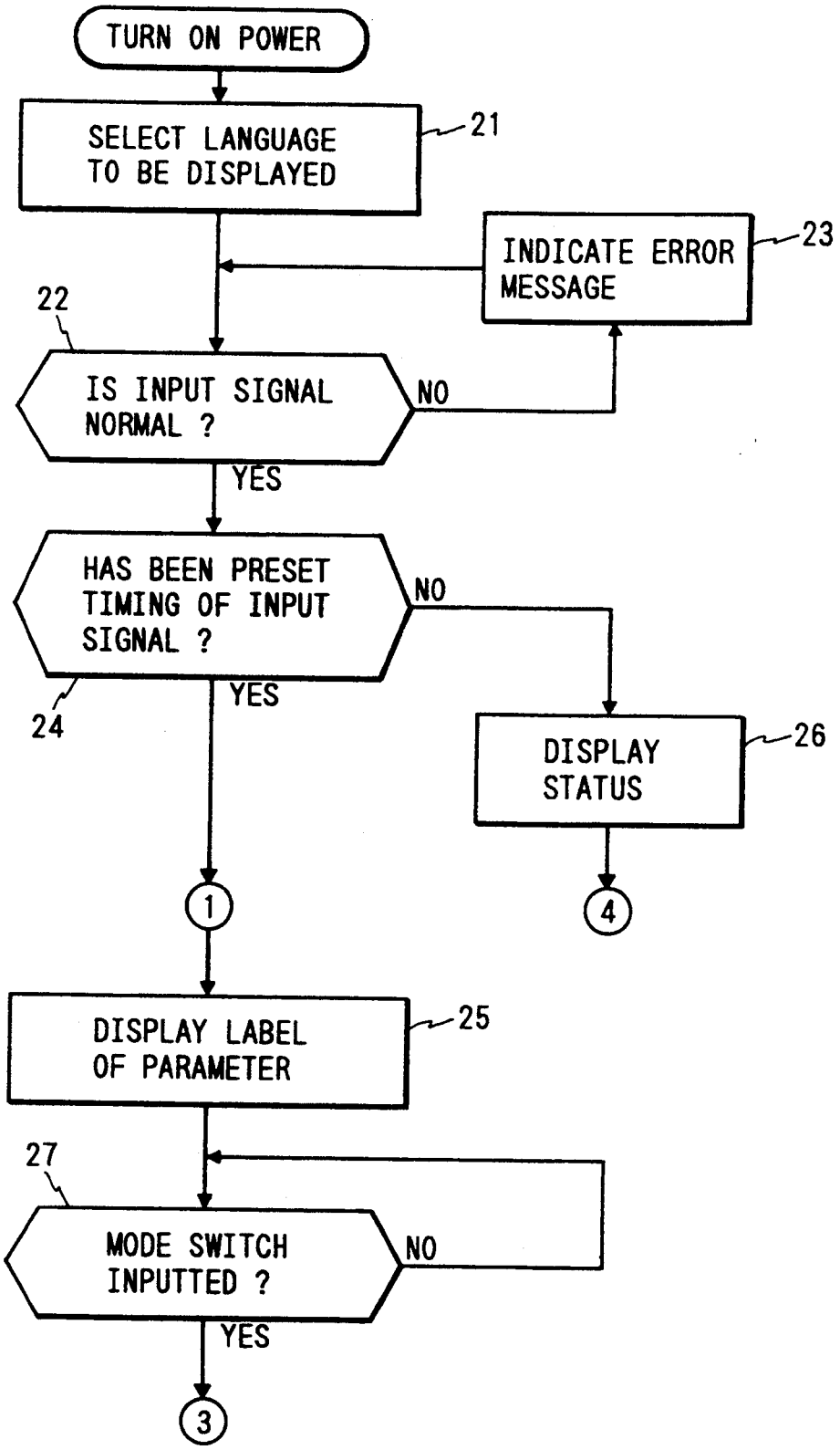
Figure 4B:
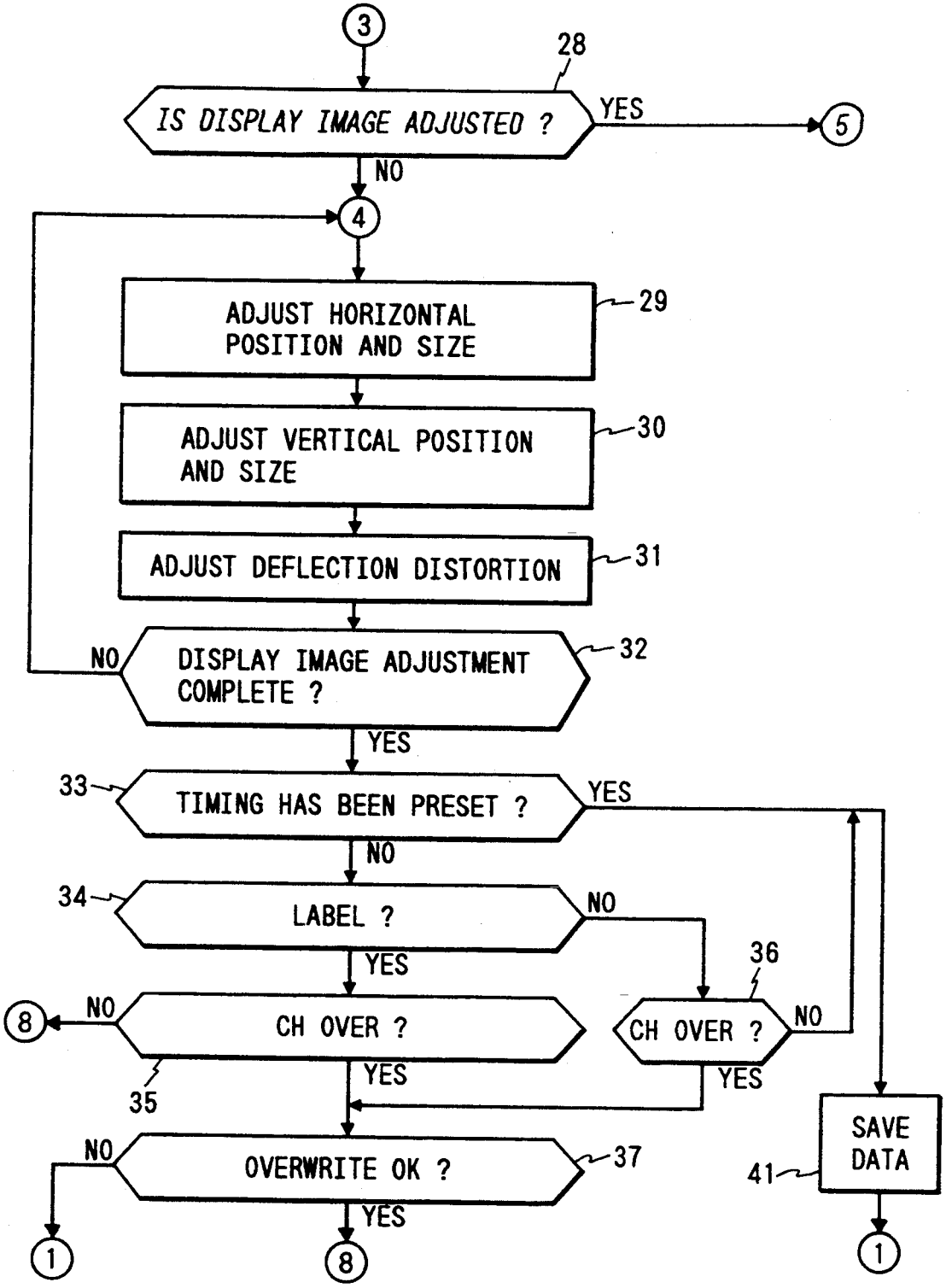
Figure 4C:
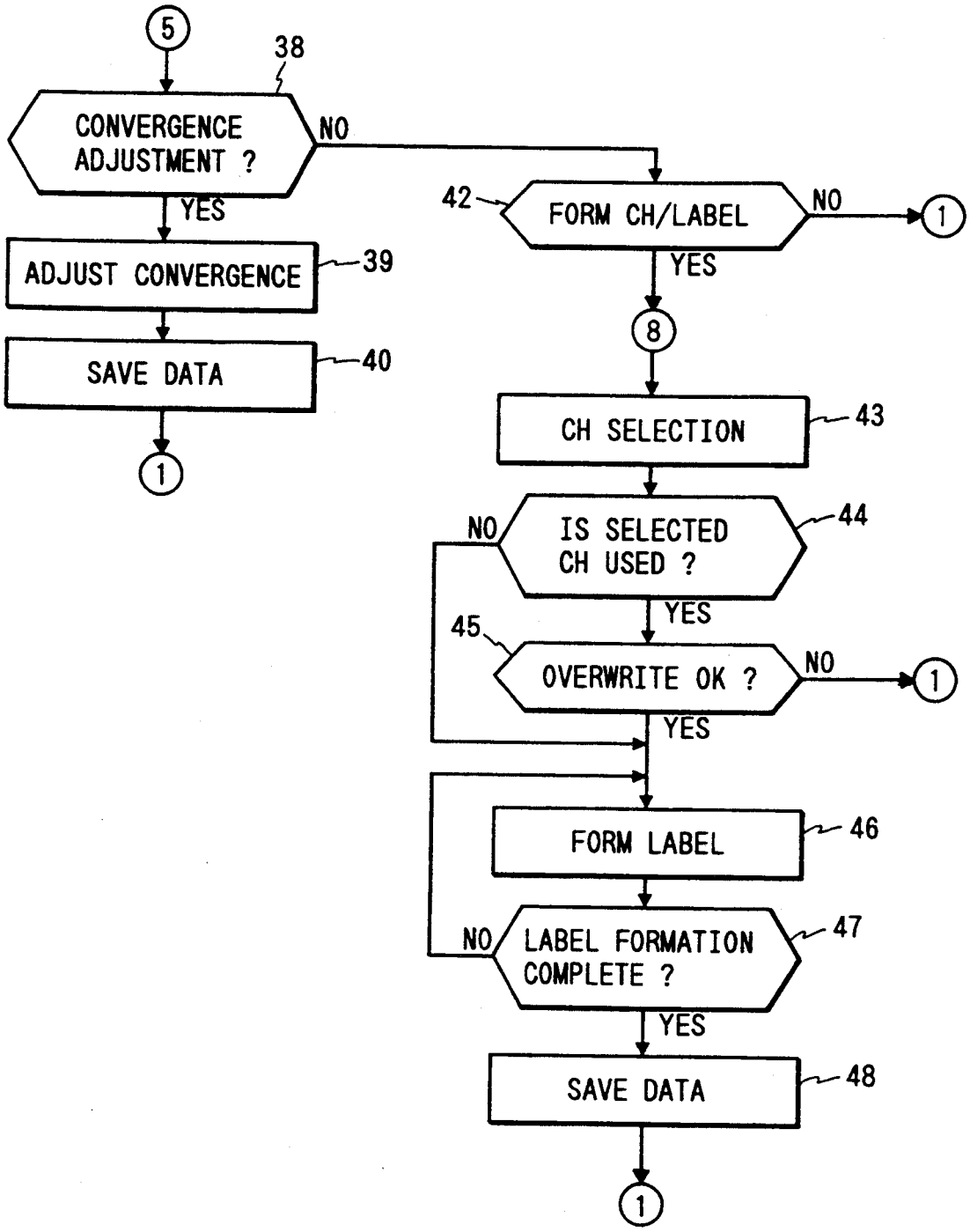

FIGS. 4A to 4C show a flow chart of essential parts of the operation of the CPU 4. The operation shown in the flow chart is started when the power switch of the CRT display device 1 is turned on.

In Step 21, immediately after the power switch is turned on, the states of the key switches 9 through 11 are detected, and a language for display is selected according to the states thus detected. For instance, when the key switch 9 has been depressed, English is selected; when the key switch 10 has been depressed, French is selected; and when the key switch 11 has been depressed, German is selected. In the case where none of the key switches 9 through 11 has been depressed, the previously selected language (stored in the memory 5) is selected again. In other words, when the power switch of the CRT display device is turned on with none of the key switches 9 through 11 depressed, the previously selected language is selected again. For convenience in description, it is assumed that English is selected.

In Step 22, the state of the input signal is detected. If the input signal is one to which the CRT display device 1 cannot respond, then it is determined that the input signal is not normal, and Step 23 is effected. When it is a signal to which the CRT display device 1 can respond, then it is determined that the input signal is normal, and Step 24 is effected.

In step 23, the state of the input signal is displayed, so as to inform the user of the fact that the CRT display device 1 cannot respond to the input signal.

Examples of the displayed state of the input signal are as shown in FIG. 5.

(a) "NO H-SYNC" is displayed when no horizontal synchronizing signal is inputted.

(b) "NO V-SYNC" is displayed when no vertical synchronizing signal is inputted.

(c) "NO SYNC SIGNAL" is displayed when none of the horizontal signal and vertical signal are inputted.

(d) "H-FREQ. OVER" is displayed when a horizontal synchronizing signal is inputted whose frequency is higher than horizontal frequencies to which the CRT display device 1 can respond.

(e) "H-FREQ. UNDER" is displayed when a horizontal synchronizing signal is inputted whose frequency is lower than horizontal frequencies to which the CRT display device 1 can respond.

(f) "V-FREQ. OVER" is displayed when a vertical synchronizing signal is inputted whose frequency is higher than vertical frequencies to which the CRT display device 1 can respond.

(g) "V-FREQ. UNDER" is displayed when a vertical synchronizing signal is inputted whose frequency is lower than vertical frequencies to which the CRT display device 1 can respond.

When no display is made on the CRT display device 1 connected to a personal computer or the like, referring to the display made on the dot matrix display unit 8 as shown in FIG. 5 the user can readily determine the reason why no display is made on the CRT display device; that is, he can determine that no display is made because the input signal is one to which the CRT display unit cannot respond, or because the CRT display device 1 is insufficiently connected to the personal computer or the like, so that no input signal is applied to the CRT display device 1, or because of other reasons.

In Step 24, it is determined whether or not a parameter corresponding to the timing of the input signal has been preset in the memory 5. In the case where it has been preset in the memory 5, Step 25 is effected; and if not, Step 26 is effected.

In Step 25, the storage number and label of the parameter preset are displayed on the dot matrix display unit 8, for instance as shown in FIG. 6. In FIG. 6, "CH13" is the storage address number, and "TOTOKU" is the label. This display informs the user of the nature of the input signal.

In Step 26, "NO PRESET FOUND" is displayed on the dot matrix display unit 8. This display is maintained for two seconds, and then Step 29 shown in FIG. 4B is effected.

In Step 29, data are displayed as shown in the part (a) of FIG. 7. In the display as shown in the part (a) of FIG. 7, "A" means the rotary switch 12, and the symbols beside "A" indicate the function of horizontal position adjustment; that is, the rotary switch 12 has the function of horizontal position adjustment. Further in the part (a) of FIG. 7, "B" means the rotary switch 13, and the marks beside "B" indicate the function of horizontal size adjustment; that is, the rotary switch 13 has the function of horizontal size adjustment. Next, "NEXT ? [Y] ENTER" is the message that "upon depression of the key switch 9, the next adjustment is carried out". That is, the user operates the rotary switches 12 and 13 (to input horizontal position and size parameters) to adjust the horizontal position and the horizontal size, and then depresses the key switch 9.

The CPU 4 applies the horizontal position and horizontal size parameters through the display I/F 6 to the display section 2, and, in response to the depression of the key switch 9, stores those parameters in the memory 5 temporarily. Thereafter, Step 30 is effected.

In Step 30, a display is performed as shown in the part (b) of FIG. 7. "A" indicates the rotary switch 12, and the marks beside "A"indicate the function of vertical position adjustment; that is, now the rotary switch 12 has the function of vertical position adjustment. Further, "B" indicates the rotary switch 13, and the marks beside "B" indicate the function of vertical size adjustment; that is, now the rotary switch 13 has the function of vertical size adjustment. Next, "NEXT ? [Y] ENTER" is the message that "upon depression of the key switch 9, the next adjustment is carried out". That is, the user operates the rotary switches 12 and 13 (to input vertical position and size parameters) to adjust the vertical position and the vertical size, and then depresses the key switch 9.

The CPU 4 applies the vertical position and size parameters through the display I/F 6 to the display section 2, and, in response to the depression of the key switch 9, stores those parameters in the memory 5 temporarily. Thereafter, Step 31 is effected.

In Step 31, a display is performed as shown in the part (c) of FIG. 7. "A" indicates the rotary switch 12, and the marks beside "A" indicate the function of pin distortion and barrel distortion adjustment; that is, now the rotary switch 12 has the function of pin distortion and barrel distortion position adjustment. Further, "B" indicates the rotary switch 13, and the marks beside "B" indicate the function of trapezoid distortion adjustment; that is, now the rotary switch 13 has the function of trapezoid distortion adjustment. Next, similarly as in the above-described Step 30, "NEXT ? [Y] ENTER" is the message that "upon depression of the key switch 9, the next adjustment is carried out". That is, the user operates the rotary switches 12 and 13 (to input a deflection distortion parameter) to perform the deflection distortion adjustment, and then depresses the key switch 9.

The CPU 4 applies the deflection distortion parameter through the display I/F 6 to the display section 12, and, in response to the depression of the key switch 9, store the parameter in the memory 5 temporarily. Thereafter, Step 32 is effected.

Steps 32, 33, 34 and 35, and Steps 43 through 46 are effected in the stated order, so that storage numbers and labels are given to the above-described parameters.

In Step 46, when the key switch 9 is depressed, the message "FINISHED ? [Y] ENTER [N] MODE" is displayed on the dot matrix display unit 8. In the message, "FINISHED ?" means "Have you finished the formation of labels, and "[Y] ENTER [N] MODE" means "Upon depression of the key switch 9, the label formation is ended, and upon depression of the key switch 10, the label formation is carried out all over again.

Under this condition, the CPU 4 operates as follows: That is, in response to the depression of the key switch 9, Step 48 is effected; and in response to the depression of the key switch 10, Step 46 is effected again.

In Step 48, the parameters stored temporarily are stored in the memory 5 in correspondence to the set storage numbers and labels. Thus, the presetting operation has been accomplished.

Upon depression of the key switch 11 during the parameter setting operation, the parameter setting operation is suspended, and jump to Step 25. In Step 25, "CH13 ****" is displayed on the dot matrix display unit 8**. This means that no parameter is set.

A CRT display of automatic frequency follow-up type can handle a number of scanning frequencies, and therefore can be connected to different kinds of personal computers or the like; however, the CRT display thus connected suffers from a difficulty that sometimes no image is displayed on the CRT.

In such a case, with the display device of the invention, the state of the input signal is displayed on the message displaying means provided in addition to the CRT, and therefore the user can readily determine the cause to deal with the trouble.

A plurality of languages are provided for the display device to display the messages, so that among the languages, a desired one is selected to display the message. That is, one CRT display device of the invention can be used for displaying the messages in any one of the plurality of languages.

What is claimed is:

1. A CRT display device on which an input signal is adapted to be processed to form an image signal, and an image is adapted to be displayed on a CRT according to the image signal thus formed, said CRT display device comprising:

input signal state detecting means for detecting a state of an input signal;

message displaying means, provided separate and distinct from said CRT, for displaying a distinct message when no image is displayed on the CRT, indicating why no image is displayed on the CRT; and display control means for displaying on said message displaying means said message so that a user can determine why no image has been displayed on the CRT and correct problems so that an image will appear on the CRT.

2. A CRT display device as claimed in claim 1 further comprising:

display language selecting means for selecting a language to be displayed on said message displaying means, said display control means displaying said message on said message displaying means in a language selected by said language selecting means.

3. A CRT display device as claimed in claim 2 further comprising memory means for storing fonts of the languages to display the message in different languages.

4. A CRT display device as claimed in claim 1, wherein said message displaying means comprises a dot matrix display means in which indicating elements are selected from the group consisting of LCD (liquid crystal display), LED (light emitting diode), EL (electroluminescence) or VFD (vacuum florescent display).

5. A display device in which an output signal is capable of being processed to form an image on the display device, said display device comprising:

a cathode ray tube on which an image processed from said input signal can be displayed;

means for displaying messages, when no image is displayed on said cathode ray tube, said means for displaying being distinct from and separated physically from said cathode ray tube; and display control means for displaying on said means for displaying, a message representing a state of said input signal which indicates specific reasons why there is no image displayed on the cathode ray tube, so that a user can read the message to determine why no image is being displayed on the cathode ray tube and take steps to provide an image on the cathode ray tube.

6. The display device according to claim 5, further comprising means to indicate messages on the means for displaying messages in different languages.

7. The display device according to claim 5 wherein said means for displaying messages is a dot matrix display.

8. A CRT display device in which an input signal is adapted to be processed to form an image signal, and an image is adapted to be displayed on a CRT according to the image signal, said CRT display device comprising:

a cathode ray tube on which an image processed from the input signal can be displayed;

input signal state detecting means for detecting a state of the input signal;

message displaying means, provided separate and distinct from said cathode ray tube, for displaying a distinct message in response to the input signal state detecting means, containing specific facts why no image is displayed on the cathode ray tube; and display control means for displaying on said message display means said message so that a user can determine the specific facts why no image is displayed on the cathode ray tube and perform steps based on the specific facts so that an image will appear on the cathode ray tube.

9. The CRT display device according to claim 8, wherein said specific facts are contained in a character string.

10. The CRT display device according to claim 8, wherein said specific facts relate to parameters of the input signal.

11. The CRT display device according to claim 10, wherein said parameters are selected from the group consisting of "NO H-SYNC"; NO V-SYNC; NO SYNC SIGNAL; H-FREQ. OVER; H-FREQ. UNDER; V-FREQ. OVER; or V-FREQ. UNDER.

12. The CRT display device according to claim 8, further including inputting means operatively connected to message displaying means, for manually inputting corrective parameters to provide an image on the cathode ray tube.

13. The CRT display device according to claim 12, wherein said inputting means includes a first and second means for inputting the means being physically distinct in structure from one another.

14. The CRT display device according to claim 13, wherein the first means includes a plurality of switches, each switch for providing a function for the second means.

15. The CRT display device according to claim 14, wherein the second means are switches for adjusting functions selected by the switches of the first means.

16. The CRT display device according to claim 15, wherein the switches of the first means are key switches.

17. The CRT display device according to claim 16, wherein the switches of the second means are rotary switches.

18. The CRT display device according to claim 17, wherein there are three key switches and the functions selected by each of the key switches is displayed on the message displaying means.

19. The CRT display device according to claim 18, wherein there are four rotary switches.

* * * * *

UNITED STATES PATENT AND TRADEMARK OFFICE

CERTIFICATE OF CORRECTION

PATENT NO. : 5,384,576

DATED : January 24, 1995

INVENTOR(S) : Tashiro et al.

It is certified that error appears in the above-indentified patent and that said Letters Patent is hereby corrected as shown below:

On the title page, left column under the designater [30] line 10 of the text the date of the "Foreign Application Priority Date" should read —September 18, 1990—

Signed and Sealed this

Sixteenth Day of May, 1995

*Attest:*

*Attesting Officer*

BRUCE LEHMAN

*Commissioner of Patents and Trademarks*